US007093731B2

(12) United States Patent
Karpisek

(10) Patent No.: US 7,093,731 B2
(45) Date of Patent: Aug. 22, 2006

(54) CONTAINER AND CONTAINER LID

(76) Inventor: Ladislav Stephan Karpisek, 92 Woodfield Boulevard, Caringbah, New South Wales 2229 (AU)

( * ) Notice: Subject to any disclaimer, the term of this patent is extended or adjusted under 35 U.S.C. 154(b) by 250 days.

(21) Appl. No.: 10/477,343

(22) PCT Filed: May 1, 2002

(86) PCT No.: PCT/AU02/00533

§ 371 (c)(1),
(2), (4) Date: Nov. 7, 2003

(87) PCT Pub. No.: WO02/090214

PCT Pub. Date: Nov. 14, 2002

(65) Prior Publication Data

US 2004/0149766 A1 Aug. 5, 2004

(30) Foreign Application Priority Data

May 8, 2001 (AU) ..... PR4829

(51) Int. Cl.
*B65D 88/00* (2006.01)

(52) U.S. Cl. ..... 220/1.5; 220/7; 220/811

(58) Field of Classification Search ..... 220/811, 220/812, 813, 348, 7, 1.5, 326, 831, 832, 220/826

See application file for complete search history.

(56) References Cited

U.S. PATENT DOCUMENTS 1,737,411 A * 11/1929 Deans ..... 220/812
5,222,790 A * 6/1993 Latino ..... 312/315
5,755,351 A * 5/1998 Kruzick ..... 220/812

FOREIGN PATENT DOCUMENTS

EP 1043239 A2 * 10/2000

* cited by examiner

*Primary Examiner*—Nathan J. Newhouse
*Assistant Examiner*—Eugene Lhymn
(74) *Attorney, Agent, or Firm*—Edwin D. Schindler

(57) ABSTRACT

A container with a container body includes two side panels and two end panels respectively upstanding from the edges of a four-sided base and a two-part lid, which can slide to a container top uncovering position and then pivot to a storage position. A securing device and a second securing device holds each lid part against the underlying top edges of the panels when the lid part is in a container top covering position. A third securing device couples each lid part, when in a storage position, to a side panel. A socket on each side panel is engaged by elements of the first securing device to facilitate pivoting of the lid parts from the container top uncovering position to their storage positions.

8 Claims, 4 Drawing Sheets

CONTAINER AND CONTAINER LID

FIELD OF THE INVENTION

This invention relates to containers generally and to lid arrangements for containers specifically.

BACKGROUND TO THE INVENTION

It is known to mount a discharge hood over the open top of a rectangular container and then to invert the container to discharge the container contents. In the known arrangements it was necessary to remove the container lid or lid assembly to allow the hood to be mounted on the container. This involved considerable physical effort due to the large size of lids required for commercial size containers which are approximately 1200 mm cube. Some efforts have been made to alleviate the problem by making the lid in two pars, but the two lid parts were still heavy for one man handling and still had to be removed in order to mount the hood.

GENERAL DESCRIPTION OF THE INVENTION

The invention provides a container comprised of two opposed side panels and two opposed end panels upstanding from a base to provide a container body and a lid of two parts respectively associated with the container side panels and when inoperative to close the container able to be secured to the associated side panels and when operative in a container top closing condition each lid part interacts with its associated side panel and both end panels.

More specifically, the lid parts are slidably movable in opposite directions as they move between the container top closing and exposing conditions and each lid part can pivot on and move linearly relative to its associated end panel to achieve securement in an overlying relationship with its associated side panel.

The invention can be defined as a container comprising a container body made up from a four sided base with two oppositely disposed side panels and two oppositely disposed end panels all upstanding from the base and two part lid means for the container body each lid part is generally rectangular in shape with two side edges and a front and a rear edge, each lid part has lugs adjacent its front edge and juxtaposed its side edges and has hook means adjacent its rear edge, said lugs form part of first retaining means to releasably hold each lid part when in operative container closing condition so its front edge is substantially in contact with upper edges of the end panels, said hook means form part of second and third retaining means to respectively hold each lid part when in an operative container top closing condition so its rear edge is substantially in contact with an upper edge of an associated one of said side panels and hold each lid part after movement to a container top exposing condition in a storage position in external overlying juxtaposition to its associated side panel, the lugs on each lid part being engagable with socket means on its associated side panel to provide pivot connections whereby said side panel can be pivoted from the container top exposing condition to said storage position.

GENERAL DESCRIPTION OF THE DRAWINGS.

Figure 1:
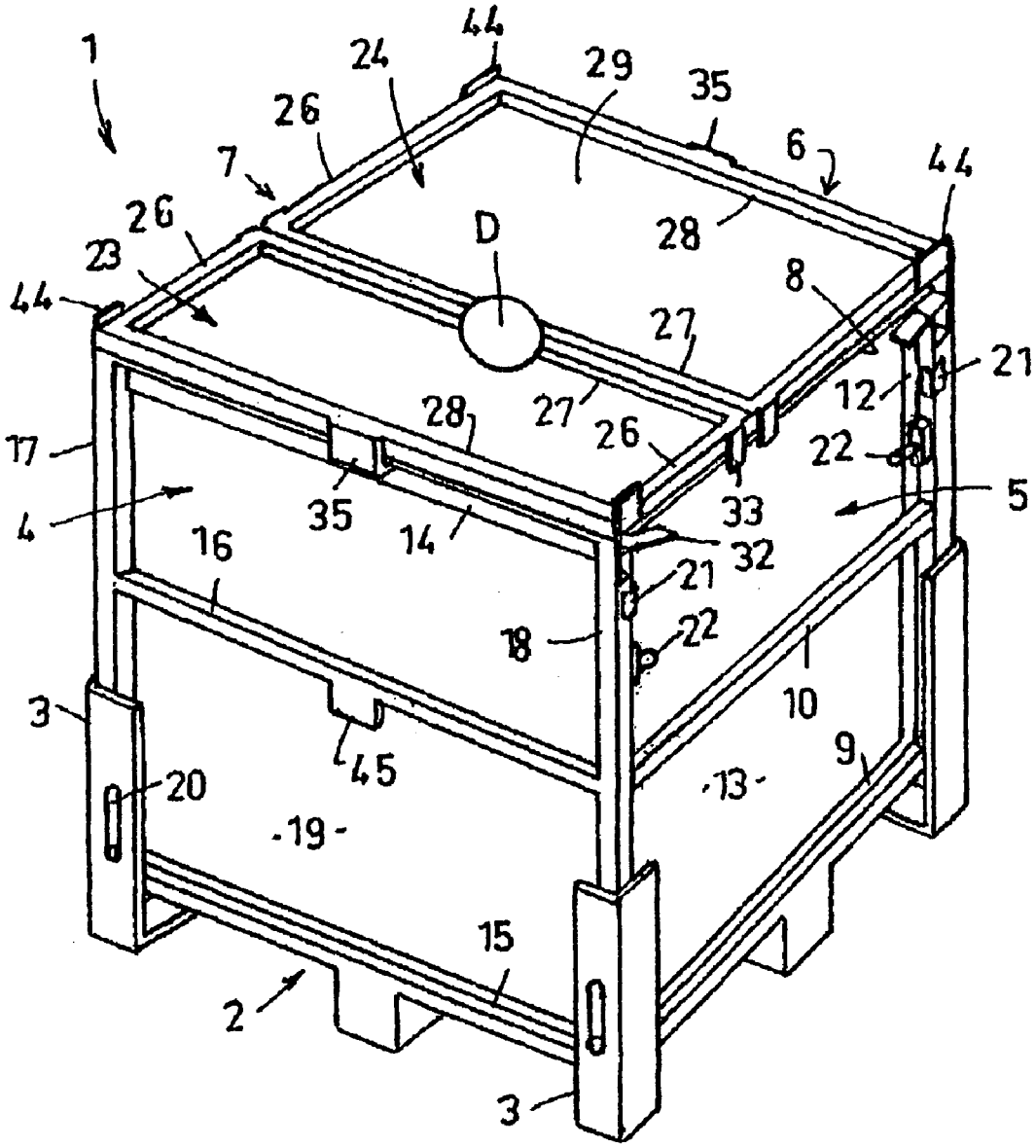
Figure 2:
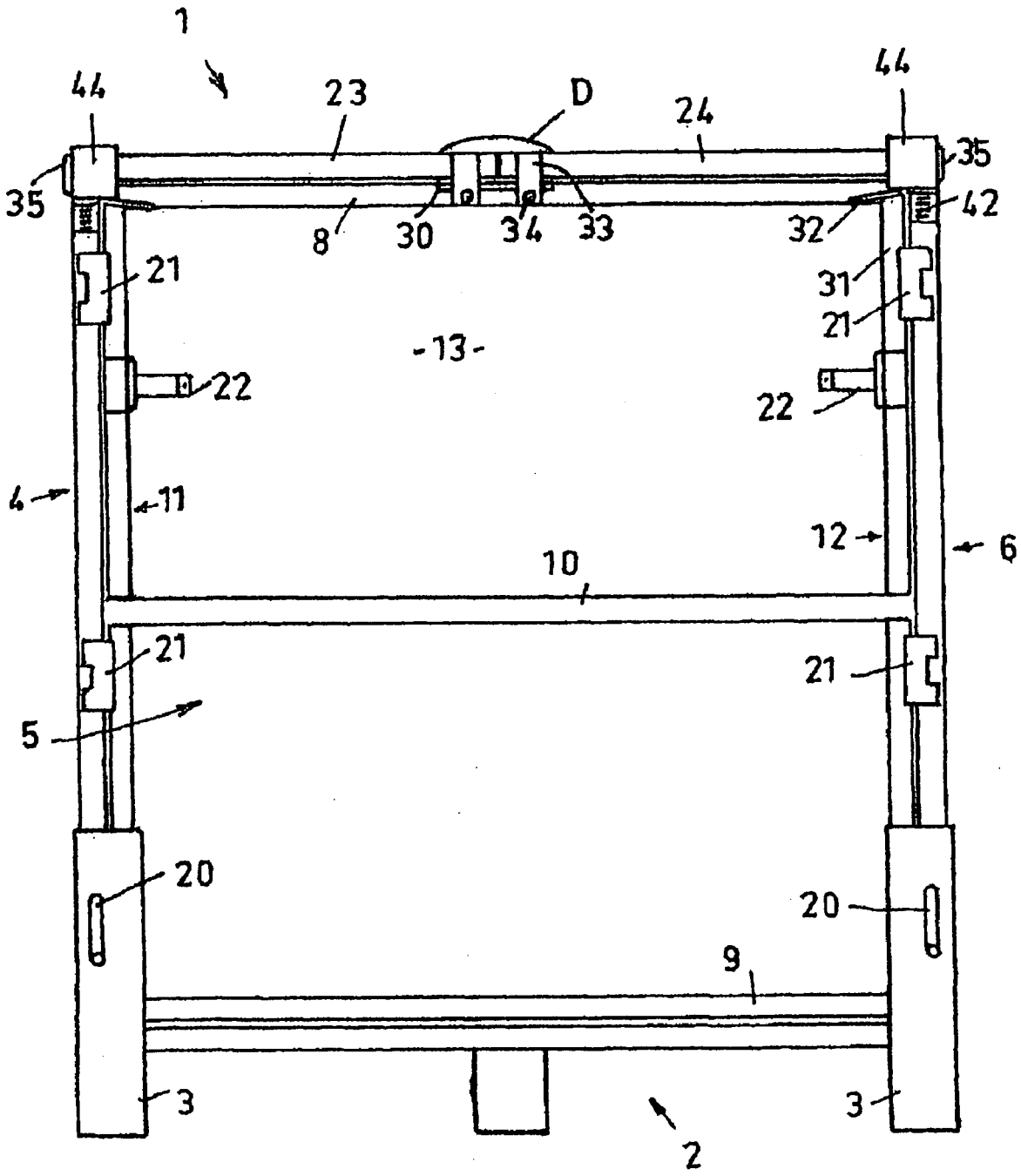
Figure 3:
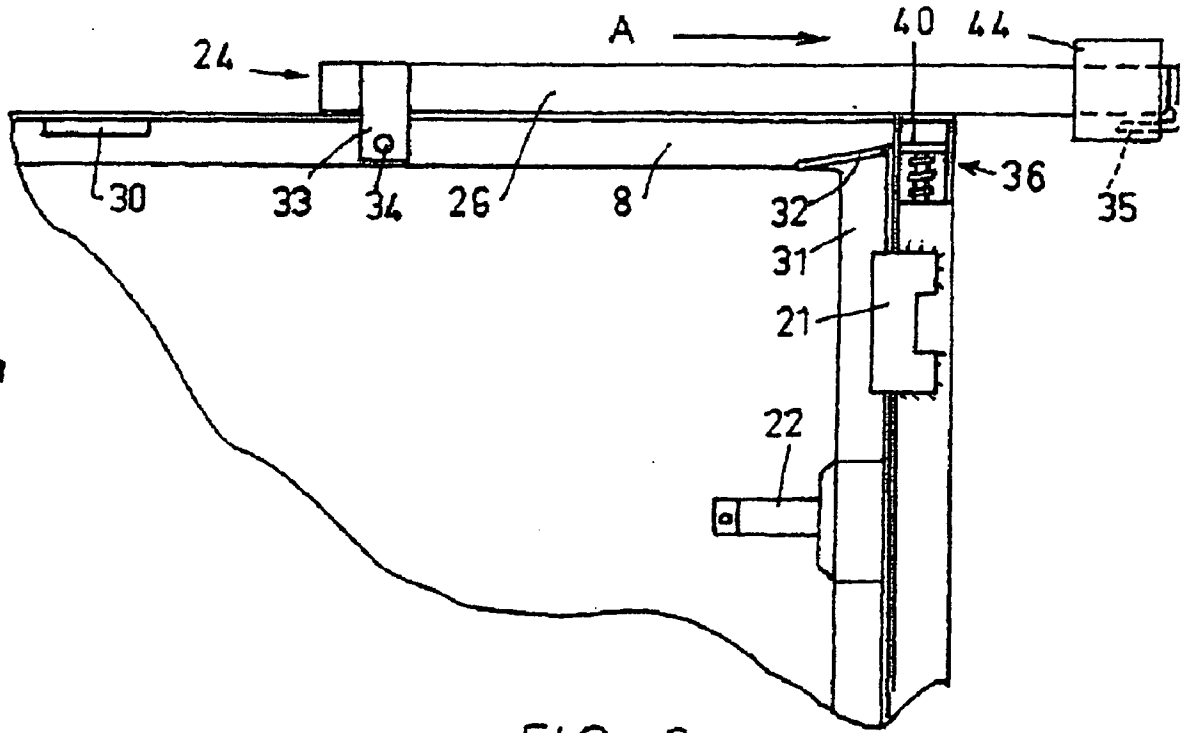
Figure 6:
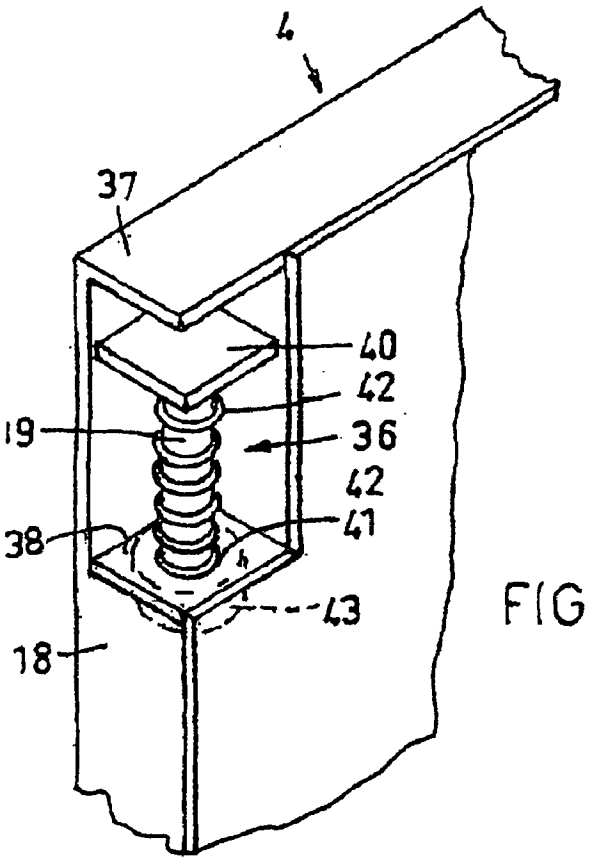
Figure 4:
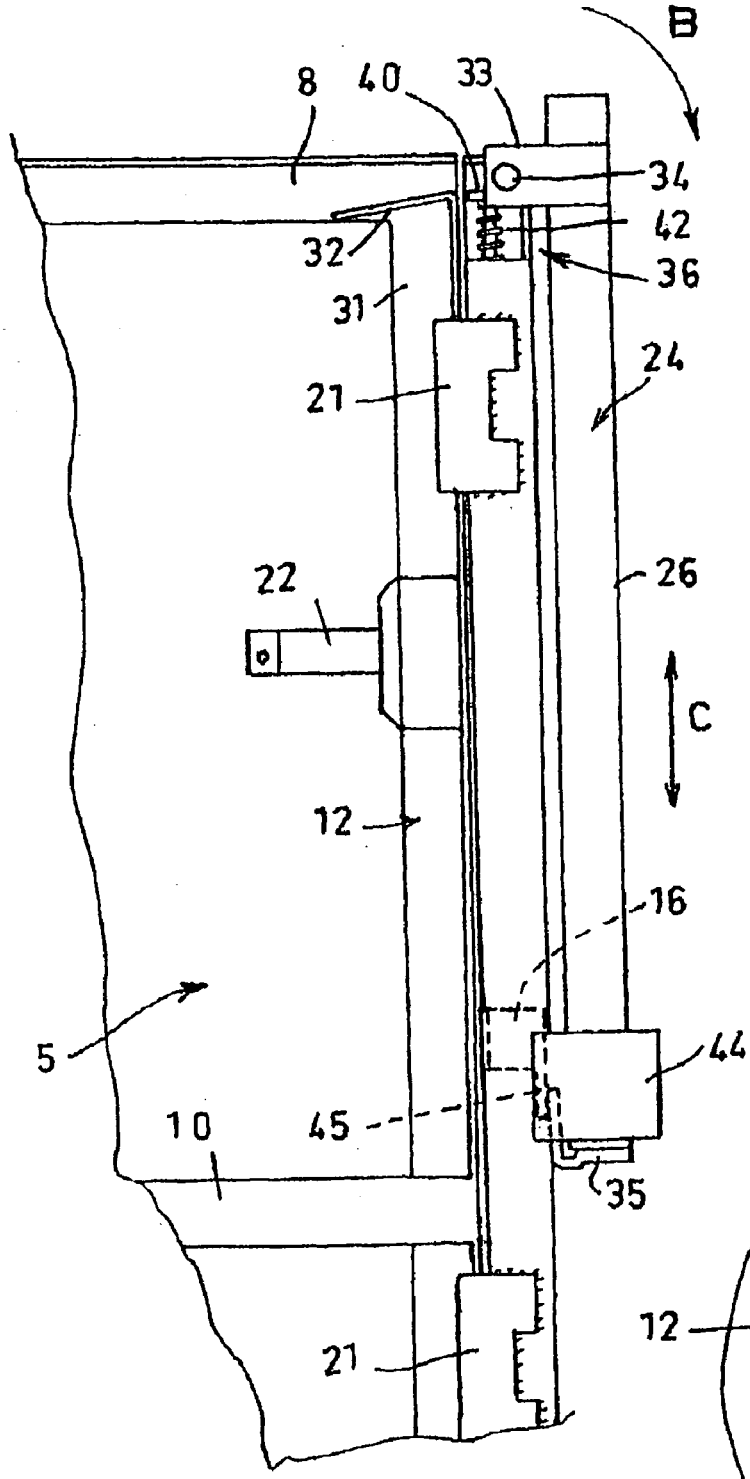
Figure 5:
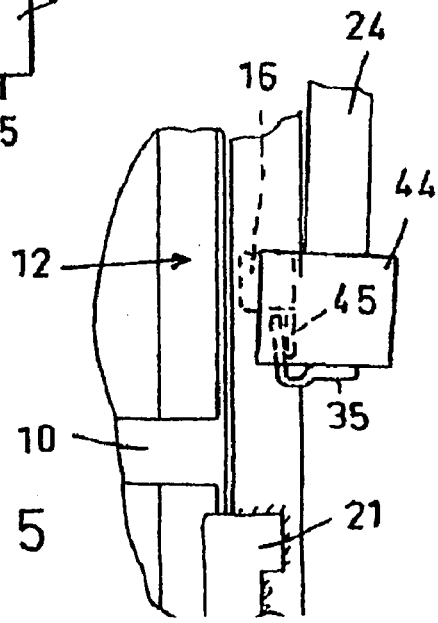

FIG. 1 is a perspective view showing schematically, and not to scale, a container with a lid as proposed by the present invention, FIG. 2 is a detailed end view of a container with a two part lid according to the present invention, FIG. 3 is an enlarged view of a fragment of the container as illustrated in FIG. 2 showing one lid part in the course of movement to uncover the top of the container body, FIG. 4 is a view similar to FIG. 3 showing the lid part after being fully withdrawn to uncover the top of the container body and pivoted to a storage position but not secured in that position, FIG. 5 is a view similar to FIG. 4 showing the lid part secured in the storage position, and FIG. 6 is an enlarged fragmentary perspective view of a socket to receive and act as a support for a pin of a lid part during pivoting movement and securement of the lid part.

DETAILED DESCRIPTION OF THE DRAWINGS.

The container 1 of the drawings schematically represents one common collapsible form of container having a four sided base 2 of pallet type with apertures at the four sides to allow engagement by the forks of a manually operated wheeled lifting truck or a conventional fork lift truck. Corner posts 3 at each corner of the container base serve to support opposed side panels 4 and 6 and opposed end panels 5 and 7 in the upstanding condition illustrated, the panels 4,5,6,7 are coupled to the base in a manner allowing the panels to be folded down one over the other over the base. This form of container is well known from a number of patents and patent applications by the present applicant and details of the coupling of the panels to the base will therefore not be described in detail. It is to be understood that the illustrated and described collapsible container is representative of one form of container with which the lid arrangement of the present invention can be used. The lid arrangement of the present invention can be used with containers which are of the non-collapsible type and with containers where the panels are fully detachable from the base.

The end panels 5 and 7 (the end panel 5 is shown in FIG. 2) includes a frame with a top rail 8, a bottom rail 9 an intermediate rail 10 and two uprights 11 and 12 joining the ends of the rails 8,9,10. All frame members, other than the rail 10 (which is made of square section tubular steel) are made of angle iron with coplanar first legs of the angle irons and out turned second legs of the angle irons. A smooth surfaced liner sheet 13 is fixed to coplanar first legs of the angle irons and may be fixed to a side of the rail 10. There is a central bearing member 30 fixed to the under face of the second leg of the angle iron top rail 8.

The side panels 4 and 6 are similarly each constructed with a top rail 14, a bottom rail 15, an intermediate rail 16 and with the exception of the bottom rail 15, which is made of angle iron, the other rails and uprights 17 and 18 joining the ends of the rails are made from square section tubular steel. A smooth liner sheet 19 is fixed to the side panel frame members.

The numerals 20 indicate coupling means of known type between the panel 5 and the base posts 3 allowing the panel 5 to fold down over the base. Similar coupling means are provided for the other panels. The numerals 21 indicate hooking elements coupling the uprights of the side panels to the uprights of the end panels and numerals 22 indicate releasable spring loaded bolts coupling adjacent uprights of side and end panels.

A two part lid 23,24 is mounted on the container body formed of the base 2 and the side and end panels. The lid parts 23,24 each comprise a rectangular frame of square metal tube with short side members 26 linking longer front and rear members 27,28. A liner sheet 29 is fixed to the coplanar inner sides of the lid frame members of each lid part frame. There are lugs 33 on the side members 26 of the lid frame parts and each lug carries an in turned pin 34.

Referring specifically to FIG. 3, the second (out turned) legs of each upright 11 and 12 of the end panels 5 and 7, identified 31, terminate short of the full height of the uprights with an ramp forming guide member 32 extending towards the centre of the panel. The configuration provides a channel with a bottom formed of the first (coplanar) leg of the angle iron top rail 8, the under face of the second (out turned) leg of the top rail 8 and the adjacent face of the guide member 32 provide sides for the channel which decreases in width in the direction extending away from the centre of the panel 5.

Referring to FIG. 2, it will be seen that when the lid parts are in position covering the open top of the container the pins 34 will bear on the under face of the bearing plate 30 which has a thickness such that the front members 27 of the lid frames are placed in substantially engaging contact with the top rails of the end panels 5 and 7. Hooks 35 on the rear members 28 of the lid parts are engaged under the top rails 14 of the side panels 4 and 6 to hold the rear members 28 of the lid parts in close relationship with the tops of the rails 14. In the above way the lid parts when covering the open top of the container are securely coupled to the container.

When lid part is moved in a separating direction of arrow A in FIG. 3 the hook 35 will disengage from the top rail 14 of te side panel 6 and lateral movement inhibiting stabilising plates 44 on the rear members 28 of the lid parts, which normally bear on the edges of the out turned legs of the top rails 8 of the end panels; will disengage from the rails 8. Simultaneously, the pins 34 will disengage from the bearing plates 30. The lid parts will freely slide along the tops of the rails 8 of the end panels 5 and 7 with the front edges 27 of the lid parts laterally stabilised by engagement between lugs 33 with the edges of the out turned legs of the top rails 8 of the end panels 5 and 7. Towards the end of movement of a lid part to uncover the container top the pins 34 will enter the wide (mouth) ends of the channels of which the guide member 32 forms part and continue up the inclined face of the guide member 32 until the pins 34 arrive at the narrow (exit) ends of the channels where they will be aligned with pin receiving sockets, indicated generally as 36, see FIG. 6, on the side panels 4 and 6, now to be described.

The pin receiving sockets, referring specifically to FIG. 6, are at the upper ends of the uprights 17 and 18 of the side panels 4 and 6. The sockets 36 are formed by removing portions of two adjacent walls of the tubes forming the uprights 17 and 18 adjacent the upper ends thereof and inserting an upper plate 37 and a lower plate 38. A shaft 39 having a head 40 is slidably mounted in a hole 41 in the lower plate 38 with a compression spring 42 disposed between the head 40 and the lower plate 38. The shaft head 40 is supported and guided by the inner faces of the remaining walls of the sockets 36 as the shaft 39 slides in the hole 41 against the action of the spring 42. A collar 43 fixed to the shaft 39 bears on the underside of the lower plate 38 due to the action of the spring 42 with the collar positioned on the shaft 39 to provide a space between the shaft head 40 and the under face of the upper plate 37 sufficient to allow a pin 34 to enter there between. It is into this position the pins 34 move after leaving the exit ends of the channels on the panels 5 and 7, see FIG. 4.

FIG. 4 shows a lid part 24 after the pins 34 enter the sockets 36 of the side panel 6 and rotation through approximately 90 degrees as indicated by arrow B to position the lid part 24 juxtaposed and substantially parallel to the side panel 6. It will be noted that with the lid part 24 in this position the hook 35 on the lid part 24 lies adjacent to a lug 45 on the intermediate bar 16 of the side panel 6. By pressing the lid part 24 in the down direction of arrow C of FIG. 4 the spring 42 can be compressed to the extent needed to allow the hook 35 to be passed below the lug 45. By then releasing the downward pressure on the lid part 24 the spring 42 will move the lid part 24 in the upward direction of arrow C of FIG. 4 to effect a lid part securing hooked engagement between the hook 35 and the lug 45, see FIG. 6.

A similar hooked engagement between the hook 35 of the lid part 23 and the lug 45 on the intermediate bar 6 of the side panel 4 will secure the lid part 23.

The secured lid parts lie outside the top edge perimeter of the enclosure formed by the panels thereby allowing the attachment of a hood to the top of the container and the securement of the lid parts permits the container with hood attached to be inverted and handled in that condition during a container emptying operation.

By reversing the several steps set forth above the container can be returned to the lid closed condition.

A retaining means of suitable form, indicated in a general manner D in FIG. 1, would be provided in a preferred arrangement to secure the front edges of the lid parts together to prevent unintended sliding separating release movement of the lid parts.

In a storage or transporting configuration of the container, where the panels are permanently hingedly connected to the base, the side panels would have the lid parts secured as described above before being folded down into a configuration with the panels overlying each other and the base. In a container configuration where the panels can be demounted from the base a side panel with a coupled half lid provide an integrated compact assembly for handling and storage.

The foregoing is a presently preferred form of the invention. It is to be understood that changes can be made to the specific construction, configuration and operation of the elements described and illustrated without departing from the inventive concepts herein disclosed and hereinafter claimed.

The invention claimed is:

1. A container, comprising:

a container body made from a four-sided base with two oppositely disposed side panels and two oppositely disposed end panels, said side panels and said end panels all upstanding from said base; and, a two-part lid for said container body, each lid part of said two-part lid being substantially rectangular with two side edges and a front edge and a rear edge, each said lid part having lugs on said side edges and adjacent said front edge and hook means on said rear edge, said lugs releasably engaging said end panels for holding each said lid part when in an operative container closing condition, so that said front edge is substantially in contact with upper edges of said end panels, said hook means holding each said lid part when in an operative container top closing condition so that said rear edge is substantially in contact with an upper edge of an associated one of said side panels and holding each said lid part after movement to a container top exposing condition in a storage position in external overlying juxtaposition to its associated side panel, said lugs on each said lid part being engagable with a socket on its associated said side panel for providing pivot connections, whereby each said lid part is pivotable from said container top exposing condition to said storage position.

2. The container according to claim 1, wherein said socket of each said side panel includes resiliently biassed support members for said lugs of its associated said lid part, said support members being movable against said resilient bias by a planar movement of the associated said lid part for allowing engagement and disengagement of the hook means of the associated said lid part with a panel lug on said side panel.

3. The container according to claim 1, wherein said end panels include a frame with a top rail having an outwardly directed limb with an under face, bearing members on said end panel extending from said under faces of said top rail, so that when engaged by said lugs of said lid parts, said front edges of said lid parts are drawn substantially into contact with said upper edges of the end panels.

4. The container according to claim 3, further comprising guidance channels on said end panels for guiding said lugs of said lid parts into said socket of each said side panel, said guidance channels having lug engagable sides formed respectively by said under face of said top rail of said end panel and guide members on said end panels adjacent distal ends of said top rails of said end panel with spacing between channel sides decreasing in a direction towards said distal ends.

5. The container according to claim 1, further comprising arms of said lid parts and guide plates at a rear edge of each said lid parts, wherein spacing between said arms on said lid parts to which said lugs of said lid parts are fixed and spacing between said guide plates at said rear edge of each said lid part are substantially the same and approximate an overall distance between outer faces of said end panels of said container body, said arms and said guide plates laterally positioning said lid parts relative to said container body when said lid parts are in said operative container top closing condition, and said arms laterally positioning said front edge of said lid parts relative to said container body during a sliding movement of said lid parts for exposing said container open top and sliding entry of said lugs into each said socket.

6. The container according to claim 1, further comprising securement means for releasably coupling said front edges of said lid parts together when said lid parts are in said container top closing condition.

7. The container according to claim 1, wherein when each said lid part is in said operative container closing condition, said hook means engages an associated one of said side panels.

8. The container according to claim 7, wherein said associated one of said side panels includes a frame with a top rail with hook means engagable surfaces.

* * * * *